United States Patent [19]

Stroucken

[11] Patent Number: 4,636,319

[45] Date of Patent: Jan. 13, 1987

[54] MAINTAINING CLOSING-LIQUID LEVEL IN CENTRIFUGES, FOR OPERATING SLIDE VALVES

[75] Inventor: Klaus Stroucken, Ronninge, Sweden

[73] Assignee: Alfa-Laval Separation AB, Tumba, Sweden

[21] Appl. No.: 742,453

[22] Filed: Jun. 7, 1985

[30] Foreign Application Priority Data

Jun. 15, 1984 [SE] Sweden ..... 8403227

[51] Int. Cl.[4] ..... B04B 11/00; B04B 7/08

[52] U.S. Cl. ..... 210/781; 210/787; 210/371; 494/27; 494/40

[58] Field of Search ..... 494/27, 40, 37; 210/137, 371, 360.1, 369, 781, 787

[56] References Cited

U.S. PATENT DOCUMENTS

| | | | |
|---|---|---|---|
| 1,050,720 | 1/1913 | Raasloff et al. | 494/37 |
| 2,454,929 | 11/1948 | Kempton | 210/137 |
| 3,079,069 | 2/1963 | Thylefors | 494/27 |
| 3,255,958 | 6/1966 | Simon | 494/37 |
| 3,403,849 | 10/1968 | Thylefors | 494/27 |
| 3,460,750 | 8/1969 | Silla | 494/27 |
| 3,797,662 | 3/1974 | Titus | 210/360.1 |
| 4,015,773 | 4/1977 | Thylefors | 494/40 |
| 4,103,822 | 8/1978 | Stroucken | 494/40 |
| 4,159,798 | 7/1979 | Grimwood et al. | 494/27 |
| 4,401,429 | 8/1983 | Koslowski | 494/40 |

*Primary Examiner*—Richard V. Fisher
*Assistant Examiner*—Linda S. Evans
*Attorney, Agent, or Firm*—Cyrus S. Hapgood

[57] ABSTRACT

In order to subject a valve within the rotor of a centrifugal separator to a certain liquid pressure, the rotor being supported by a vertical drive shaft (13), a liquid surface is maintained during operation of the rotor very close to the axis of the rotor, this surface being formed within a central channel (12) through said drive shaft (13). The lower end of the drive shaft, in which the channel (12) opens axially through an orifice (31) having its surrounding edge at the desired radial level for the liquid surface, is rotated in a liquid body which is kept in a container (25) below the drive shaft (13).

4 Claims, 3 Drawing Figures

MAINTAINING CLOSING-LIQUID LEVEL IN CENTRIFUGES, FOR OPERATING SLIDE VALVES

Figure 1:
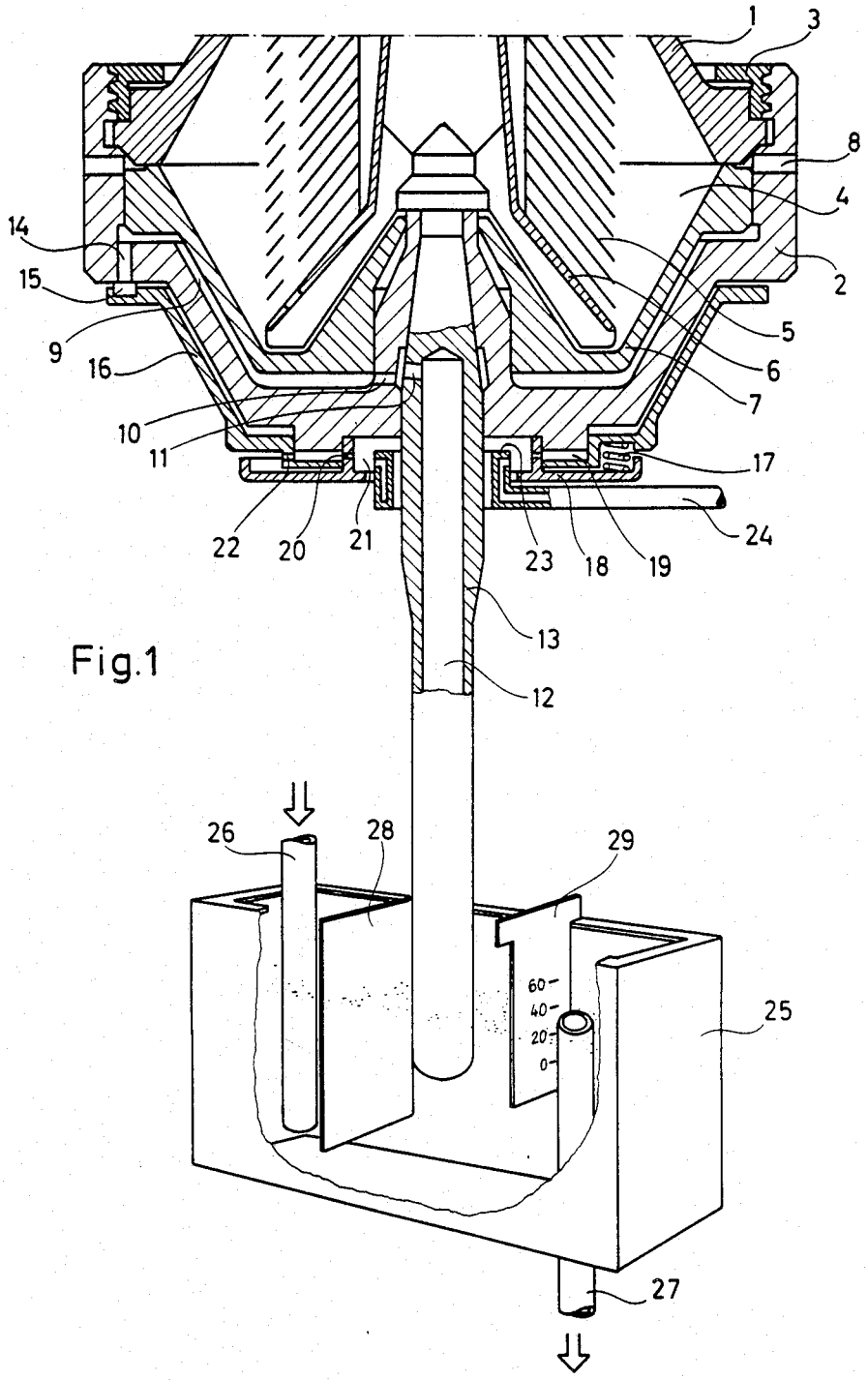

The present invention relates to a method and device for maintaining a liquid surface of a liquid body in the rotor of a centrifugal separator at a radial level very close to the axis of the rotor in order to subject a valve in the rotor to a predetermined liquid pressure, the rotor being supported by a vertical drive shaft.

In centrifugal separators having a rotor with intermittently openable outlets, there is often arranged an annular slide valve which is axially movable within the rotor for opening and closing these outlets. The slide valve is hydraulically actuated in a closing direction by means of a liquid body maintained in a chamber in the rotor during its rotation. In a common rotor design, the slide valve forms a movable wall between the separation space of the rotor and said chamber. The chamber is often called closing chamber, and the liquid supplied to the closing chamber is often called closing liquid.

The liquid body, i.e. the closing liquid, that is maintained in the closing chamber has a liquid surface during rotation of the rotor which is facing the rotor axis and is situated at a certain distance therefrom. The size of this distance is of significance for the liquid pressure exerted by the closing liquid on said slide valve. Thus, a decreasing distance means an increasing liquid pressure on the slide valve.

The liquid pressure exerted on the slide valve by the closing liquid must overcome the liquid pressure on the slide valve from the liquid situated in the separation space of the rotor, in order that the slide valve may be able to keep said outlets from the separation space closed. Since the liquid in the separation space, in certain cases, is of a kind heavier than the water usually used as closing liquid, it may be desirable to maintain a liquid surface in the closing chamber as near the rotor axis as possible. Also from other points of view this may sometimes be desirable.

Closing liquid is normally supplied to the closing chamber through a stationary pipe extending parallel with the rotor drive shaft into the rotor, where it opens into an annular groove. The groove opens radially inwards toward the rotor axis and communicates radially outward with the closing chamber. The position of the liquid surface that can be formed by the coherent liquid body in the closing chamber and the supply groove will therefore be dependent on the fact that room must be left for the stationary supply pipe between the rotor drive shaft and the liquid surface.

In cases where an even higher liquid pressure must prevail in the closing chamber than can be achieved by means of the arrangement just described, there is another known arrangement for the supply of closing liquid. According to this, the closing chamber is connected directly with an axial channel in the rotor drive shaft, which in turn at its lower end is connected via a mechanical seal with a channel in a stationary conduit for supply of pressurized closing liquid. By such an arrangement, a substantially higher pressure can be achieved in the closing chamber than by supplying closing liquid though an open groove at the center of the rotor.

However, an arrangement with a mechanical or another kind of seal between the rotor drive shaft and a stationary conduit for the supply of closing liquid is vulnerable, as the seal may be worn and have to be exchanged. In certain cases (e.g., marine separators) this is considered to be an appreciable inconvenience which should be avoided. Besides, an arrangement of this kind is sometimes over-qualified regarding the possibility of supplying closing liquid to the rotor at super-atmospheric pressure. In many cases it would suffice for the free liquid surface of the liquid body in the closing chamber to be located somewhat closer to the rotor axis than is possible when supplying closing liquid through an open groove within the rotor.

The principal object of the present invention is to fulfill the need just mentioned—without using a mechanical seal—by providing a new method and device for maintaining a liquid surface of a liquid body, present in the rotor, at a radial level very close to the rotor axis.

This can be achieved by creating, during operation of the rotor, a liquid surface within a channel which extends axially through said drive shaft to the rotor, the lower end of the drive shaft, in which said channel opens axially through an orifice having its surrounding edge at the desired radial level, being rotated in a liquid body that is maintained in a container placed below the drive shaft.

In this way, there can be maintained in the rotor drive shaft a cylindrical liquid surface which is not permitted to move radially inside the edge forming the opening of said channel in the container and which remains at the desired level as long as the end of the drive shaft is kept rotating in liquid. Thus, liquid is permitted to flow into the channel during rotation of the rotor, until a cylindrical liquid surface has been formed within the drive shaft and has moved radially inwards to the level of said edge. After that, the same edge will maintain the level of the cylindrical liquid surface within the drive shaft.

Figure 2:
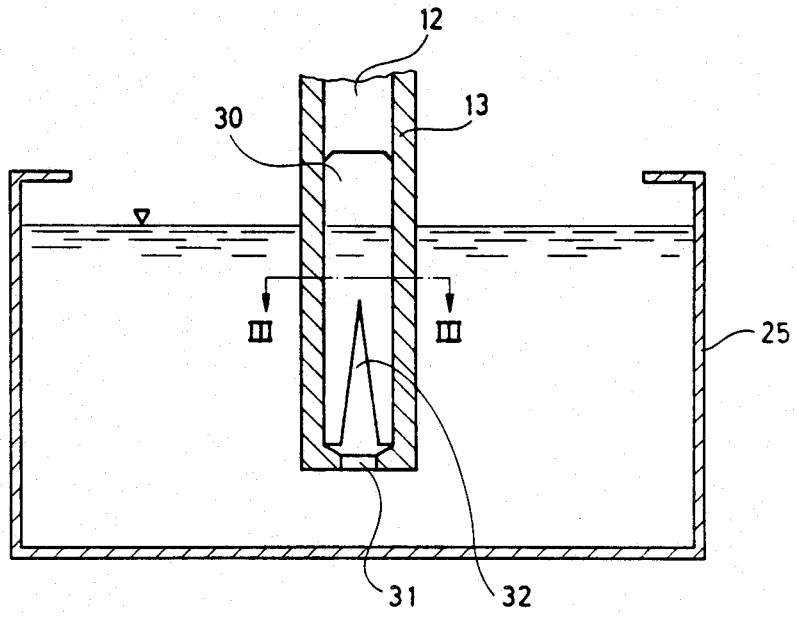
Figure 3:
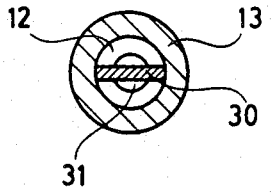

A preferred embodiment of the device for carrying out the new method will be described below with reference to the accompanying drawings in which FIG. 1 is an axial sectional view of the lower part of the rotor of a centrifugal separator and a container for liquid situated below the rotor;

FIG. 2 is a sectional view of the container in FIG. 1 and the lower end portion of the rotor drive shaft, and FIG. 3 is a sectional view along the line III—III in FIG. 2.

The centrifuge rotor in FIG. 1 comprises two parts 1 and 2, which are kept together axially by a lock ring 3. Within the rotor is a separation space 4, in which a set of conical separation discs 5 is arranged. The discs 5 rest on the lower part of a distributor 6 adapted to distribute liquid, centrally received in the rotor, evenly to different parts of the separation space 4.

In FIG. 1 an axially movable slide 7, forming the bottom of the separation space 4, abuts the rotor part 1 with its annular circumference portion. Thereby, the separation space 4 is closed from communication with a number of peripheral outlets 8 formed in the rotor part 2.

Between slide 7 and the lower rotor part 2 there is formed a chamber 9 intended to contain so-called operating liquid, usually water. The chamber 9 communicates through openings 10 and 11 with a channel 12 formed centrally in a shaft 13. The latter is rigidly connected with the rotor part 2 and constitutes the rotor drive shaft. A driving device (not shown) is provided for driving the shaft 13. Further, the drive shaft is journalled in a way not shown but which may be conventional.

At its circumference, the lower rotor part 2 has a number of axial bores 14 serving as outlets for operating liquid from chamber 9. The bores 14 are covered at the outside of the rotor body by closing members 15 carried by an axially movable operating slide 16. The latter is actuated to a closing position of the closing members 15 by means of a number of coil springs 17 arranged between the operating slide 16 and a support plate 18 rigidly connected to the rotor part 2.

The radially innermost part of the operating slide 16 forms together with the rotor part 2 an additional chamber 19 for operating liquid. The chamber 19 has a central inlet in the form of a large number of openings 20 in a wall forming the bottom of an annular groove 21 which is open radially inwards. The chamber 19 has one or a few outlets 22 in its radially outer wall. The inlets 20 and outlets 22 are so dimensioned that during operation of the rotor more liquid can flow into the chamber 19 than can leave it.

A stationary annular supply member 23 connected to a conduit 24 is provided for intermittent supply of liquid to the groove 21.

The rotor drive shaft 13 extends down into an upwardly open container 25 having a supply pipe 26 and a drain pipe 27 for liquid. The upper end of the drain pipe 27 forms an overflow outlet for liquid in the container, so that a certain liquid level is maintained therein. To counteract rotation of the liquid in container 25, caused by the rotor drive shaft 13, a number of flanges 28, 29 are provided in the container. Additional flanges for the same purpose could be provided in various ways in the container 25.

In FIG. 2 the container 25 is shown without the said flanges and pipes but containing liquid. The liquid level has been indicated by a small triangle. Further, the lower end portion of the rotor drive shaft 13 is shown.

As can be seen from FIGS. 2 and 3, an entrainment blade 30 is provided within the channel 12 of the drive shaft. The channel 12 opens axially into the interior of the container 25 through a central hole 31 having a diameter which is smaller than the diameter of the channel 12. The blade 30 has a slot 32 opposite to the hole 31.

In the operation of the device, when drive shaft 13 is brought into rotation, a liquid annulus with a cylindrical liquid surface will be formed within its channel 12. Thus, liquid will flow upwards along the walls of the channel 12 and further out through the openings 11 and 10 to the chamber 9 in the rotor. At this stage, new liquid is flowing into the channel 12 through hole 31. When chamber 9 is filled with liquid, the liquid flow through hole 31 will cease, and the cylindrical liquid surface in the channel 12 will be positioned at the radial level of the edges surrounding the hole 31. This radial level, very close to the axis of the rotor, will determine the liquid pressure which prevails in the chamber 9 and which, among other things, exerts a closing force against the underneath side of the slide 7.

This force against the underneath side of the slide is larger than the force acting in the opposite direction against the upper side of the slide 7 from liquid present within the rotor separation space 4. The peripheral outlet openings 8 are thus kept closed. When the outlet openings 8 are to be opened, liquid is supplied through the pipe 24, supply member 23, groove 21, and inlets 20 to chamber 19. A liquid pressure is then created in the chamber 19, which overcomes the spring force acting in the opposite direction on the operating slide 16. Thus, the slide 16 is moved axially downwards so that the outlet openings 14 from chamber 9 are uncovered. As a result, liquid leaves the chamber 9 at a higher speed than new liquid can be supplied to the same through channel 12 in the drive shaft. The slide 7 then moves downward and uncovers the outlet openings 8 from the separation space 4.

When the liquid flow through pipe 24 to chamber 19 is interrupted, this chamber is drained through the outlets 22. The operating slide 16 therefore returns to its upper position because of the force from the springs 17, and the outlets 14 from chamber 9 are closed. The chamber 9 now begins to be refilled with liquid which has been flowing continually in through the openings 10, 11 from the channel 12. As soon as the pressure against slide 7 from the liquid in chamber 9 exceeds the pressure against the same from liquid in the separation space 4, the slide 7 returns to its upper positon in which the outlet openings 8 are closed.

After the above-described operation—as well as before the same—the previously mentioned liquid level in the channel 12 of the drive shaft is automatically maintained.

If desirable, the lower end portion of drive shaft 13 (i.e., the portion enclosing the blade 30) may be formed as a separate member (e.g., of plastics), which could be releasably connected to the rest of the drive shaft. Thereby, several such separate members may be produced with various sizes of the hole 31 for one and the same drive shaft.

Further, if desirable, the part of channel 12 in which the blade 30 is provided may be given a greater diameter than that of the rest of the channel.

I claim:

1. In the operation of a centrifugal separator having a rotor mounted on a vertical drive shaft for rotation about an axis, said shaft having a channel extending axially from the lower end of the shaft to the rotor, said rotor containing a control valve operable by a fluid pressure, the method which comprises maintaining the lower end of the shaft in a liquid body, rotating the rotor through said shaft to cause liquid from said body to flow upward in said channel along its surrounding wall and thence radially outward to a location where the liquid applies its pressure to said valve, the liquid in said channel forming an annulus with a cylindrical inner surface, flowing the liquid from said body into the channel by way of an orifice located at said lower end of the shaft and having a surrounding edge spaced a shorter distance from said axis than is said surrounding wall, and maintaining said cylindrical surface at substantially said shorter distance from said axis throughout the liquid flow from said orifice to the point where the liquid undergoes said radially outward flow.

2. The method of claim 1, comprising also changing the size of said orifice and thereby adjusting the magnitude of the liquid pressure on the valve.

3. In combination with a centrifugal separator having a rotor, a vertical drive shaft supporting the rotor and operable to drive it about a vertical axis, and a control valve in the rotor operable by a liquid pressure, means for operating said valve comprising a container of liquid in which the lower end of the shaft is immersed, said shaft having an axial channel extending upwardly into the interior of the rotor, the rotor having a passage leading outwardly from the upper part of said channel to said valve, and means on the lower end of the shaft defining an orifice through which said channel opens downwardly and axially into said liquid, the radial extension of said orifice being smaller than that of said channel throughout the length of the channel from the orifice to said rotor passage, whereby rotation of the shaft and rotor causes liquid from said container to form in said channel an annulus from which liquid acts on the valve, said annulus having a cylindrical surface spaced from said axis a short distance corresponding to the radial extent of said orifice and which determines the pressure exerted by the liquid on the valve.

4. The combination of claim 3, comprising also means in the lower portion of said channel operable to entrain liquid from said container during rotation of the shaft.

* * * * *